US008269148B2

(12) United States Patent
Marchand

(10) Patent No.: US 8,269,148 B2
(45) Date of Patent: Sep. 18, 2012

(54) COOKTOP WITH FORCED CONVECTION COOLING

(75) Inventor: Joseph Marc Pierre Marchand, Terrebonne (CA)

(73) Assignee: Electrolux Home Products, Inc., Cleveland, OH (US)

( * ) Notice: Subject to any disclaimer, the term of this patent is extended or adjusted under 35 U.S.C. 154(b) by 1028 days.

(21) Appl. No.: 12/237,666

(22) Filed: Sep. 25, 2008

(65) Prior Publication Data

US 2010/0072189 A1 Mar. 25, 2010

(51) Int. Cl.
*H05B 3/68* (2006.01)

(52) U.S. Cl. ..... 219/449.1; 219/452.11

(58) Field of Classification Search ..... 219/600, 219/601, 620, 622, 623, 624, 443.1–468.2
See application file for complete search history.

(56) References Cited

U.S. PATENT DOCUMENTS

| | | | | |
|---|---|---|---|---|
| 3,838,505 | A | 10/1974 | Doner | |
| 3,870,862 | A * | 3/1975 | Doner | 219/452.12 |
| 4,191,875 | A * | 3/1980 | Cunningham | 219/623 |
| 4,415,788 | A | 11/1983 | Field | |
| 4,431,892 | A | 2/1984 | White | |
| 4,511,781 | A * | 4/1985 | Tucker et al. | 219/626 |
| 4,549,052 | A | 10/1985 | Simon | |
| 4,551,600 | A | 11/1985 | Miyagawa et al. | |
| 4,665,893 | A | 5/1987 | Miyagawa et al. | |
| 6,444,958 | B1 | 9/2002 | Campbell | |
| 6,956,188 | B2 * | 10/2005 | de Rooij et al. | 219/619 |
| 7,049,552 | B2 | 5/2006 | Arntz et al. | |
| 7,652,229 | B2 * | 1/2010 | Alves et al. | 219/448.11 |
| 2004/0177841 | A1 | 9/2004 | Little et al. | |

FOREIGN PATENT DOCUMENTS

| | | |
|---|---|---|
| EP | 0663567 | 7/1995 |
| EP | 1790911 | 5/2007 |
| GB | 2447134 | 9/2008 |
| WO | 2008082075 | 7/2008 |

OTHER PUBLICATIONS

International Search Report for PCT/US2009/057631, dated May 11, 2010, 3 pages.

* cited by examiner

*Primary Examiner* — Sang Paik
(74) *Attorney, Agent, or Firm* — Pearen & Gordon LLP

(57) ABSTRACT

A ventilation system for cooling a cooking appliance that can be placed within a kitchen countertop is described. The cooking appliance includes one or more air inlets within the sides of the cooktop, and an air mover that draws air in through the air inlets and over control circuits provided within the frame of the cooking appliance.

20 Claims, 9 Drawing Sheets

COOKTOP WITH FORCED CONVECTION COOLING

FIELD OF THE INVENTION

The present invention relates to a ventilation system for cooling a cooking appliance that can be placed within a kitchen countertop, and more particularly to a ventilation system that cools the circuitry used by the control elements of a cooking appliance.

BACKGROUND

Smooth-top cooking surfaces known as cooktops are well known in the art. A cooktop is a type of kitchen stove that just has burners on the top and is usually installed into a countertop. A typical cooktop includes a frame having secured thereto a plurality of heating elements which are covered by a glass-ceramic panel or other type of cooking surface. In addition, the cooktop includes a plurality of control elements, each of which is associated with operating a corresponding heating element mounted to the cooktop. Increasingly, the control elements interact with heat sensitive microprocessors included within the frame of the cooktop. However, demand for higher power output, together with the development of more compact designs, has made it increasingly difficult to maintain cool operating temperatures for the control electronics, as well as the cooktop periphery and cabinet.

To help maintain cooler temperatures, a variety of ventilation systems have been developed for cooktop stoves. These ventilation systems typically involve venting the cooktop through inlet holes provided in the surface of the cooktop. Some of these ventilation systems also provide the capability to direct airflow over the electronics associated with the control elements. However, including inlet holes in the surface of a cooktop decreases the amount of usable surface, can be unsightly, and can also result in foods or liquids being trapped within the frame of the cooktop.

Accordingly, there exists a need for an unobtrusive ventilation system which will effectively cool control elements, associated electronics and areas around heating elements below a cooktop appliance.

SUMMARY OF THE INVENTION

The present invention provides a ventilation system for improving the ventilation of a cooktop cooking appliance. In one aspect, the invention provides a cooking appliance configured to fit within a countertop opening in a countertop that includes a frame including a bottom wall and a peripheral side portion extending from an outer periphery of the bottom wall to define a chassis for the cooking appliance; a cooktop positioned on top of the frame; one or more air inlets on a cooktop side of the cooktop; a heating element enclosure positioned underneath the cooktop and within the frame comprising one or more heating elements; an air mover underneath the heating element enclosure; and one or more control circuits positioned between the air inlet and the air mover. Operation of the air mover of the cooking appliance draws in air through the air inlet and over the one or more control circuits. In one embodiment of the cooking appliance, the cooktop includes a glass-ceramic material.

In another embodiment of the cooking appliance, the cooktop includes a plurality of cooking zones. In a further embodiment, the heating element is selected from the group consisting of infrared halogen lamps, electric heating coils, ribbon heaters, and induction coils, or specifically a ribbon heater. In some embodiments, the heating elements can provide high power output. In other embodiments, the cooktop includes a user interface with one or more touchpad controls that are operatively connected to the control circuits.

In another embodiment of the cooking appliance, the cooktop is about flush with the countertop when the cooking appliance is positioned within the countertop opening. In further embodiments, a deflector is positioned on the frame to cover a lower portion of the air inlet. In additional embodiments, one or more louvers are provided on the frame underneath the deflector. In yet another embodiment, a trim that includes one or more air vents is positioned over a side of the countertop that includes an air inlet.

The cooking appliance can include one ore more air outlets and/or air inlets. For instance, in one embodiment, one or more air outlets are provided in one or more cooktop sides of the cooktop. In a further embodiment, the cooking appliance includes a plurality of air outlets. In yet further embodiments, the cooking appliance includes a plurality of air inlets. In another embodiment, the frame further includes a ventilation chamber comprising one or more air movers positioned to expel air through one or more air outlets in the ventilation chamber.

Another aspect of the present invention provides a cooking appliance configured to fit within a countertop opening in a countertop that includes a frame including a bottom wall and a peripheral side portion extending from an outer periphery of the bottom to define a chassis for the cooking appliance; a glass-ceramic cooktop positioned on top of the frame comprising a user interface and a cooking region, wherein the cooktop is about flush with the countertop when placed in an opening in the countertop; an air inlet on a cooktop side of the cooktop; an air outlet in the bottom wall of the frame; a deflector is positioned on the frame to cover a lower portion of the air inlet and air outlets; a heating element enclosure positioned underneath the cooktop and within the frame comprising one or more heating elements; an air mover underneath the heating element enclosure; and one or more control circuits positioned between the air inlet and the air mover. Operation of the air mover of the cooking appliance draws in air through the air inlet and over the one or more control circuits.

In additional embodiments of this aspect of the invention, the cooking appliance can include a plurality of air inlets in one or more cooktop sides of the cooktop. In another embodiment, a trim including one or more air vents is positioned over a side of the countertop that includes an air inlet is provided. In other embodiments, the heating element is selected from the group consisting of infrared halogen lamps, electric heating coils, ribbon heaters, and induction coils. In yet another embodiment, the cooking appliance includes one or more air outlets in one or more cooktop sides of the cooktop.

Unless otherwise specified, "a," "an," "the," and "at least one" are used interchangeably and mean one or more than one. Also herein, the recitations of numerical ranges by endpoints include all numbers subsumed within that range (e.g., 1 to 5 includes 1, 1.5, 2, 2.75, 3, 3.80, 4, 5, etc.). It is also understood that all spatial references, such as "horizontal," "vertical," "top," "upper," "lower," "bottom," "left," and "right," are for illustrative purposes only and can be varied within the scope of the disclosure.

The above summary of the present invention is not intended to describe each disclosed embodiment or every implementation of the present invention. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

Figure 1:
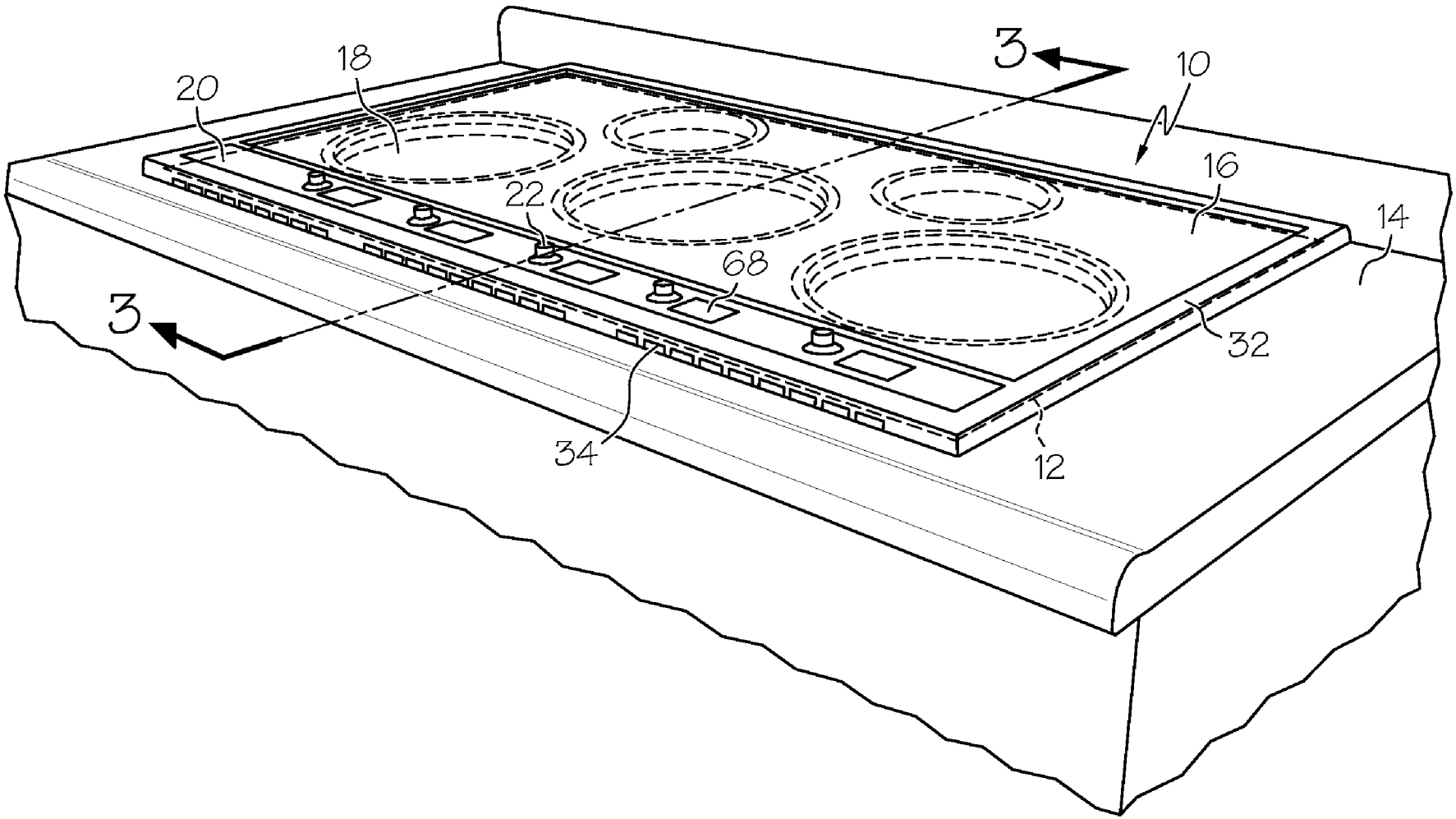
FIG. 1 is an upper right perspective view of an embodiment of the cooking appliance that is fitted into the countertop opening of a countertop.

The following detailed description is to be read with reference to the figures, in which like elements in different figures have like reference numerals. The figures, which are not necessarily to scale, depict selected embodiments and are not intended to limit the scope of the invention. Skilled artisans will recognize the embodiments provided herein have many useful alternatives that fall within the scope of the invention.

DETAILED DESCRIPTION OF EMBODIMENTS OF THE INVENTION

The present invention provides a cooking appliance that includes a ventilation system for cooling the appliance. An embodiment of the invention is shown in FIG. 1, which shows perspective view of a cooking appliance 10 that has been placed a countertop opening 12 of a countertop 14. The cooking appliance 10 includes a cooktop 16 positioned over a portion of the countertop 14. The cooktop 16 can be positioned so that it is about flush with the countertop 14 when the cooking appliance 10 is placed within the countertop opening 12. Alternately, the cooktop 16 can be slightly elevated with respect to the countertop 14 (e.g., by about 1-2 ml). It will be understood that the cooking appliance 10 can be used to provide heat for a variety of cooking purposes, but that it can be used to provide heat to items for non-cooking purposes as well. The countertop 14 can be a kitchen countertop, or it can be a countertop 14 provided in another location.

The cooktop 16 includes flat working surface and is typically but not necessarily provided in a rectangular shape. For example, cooktops 16 may be provided with dimensions of about 20 inches by 30 inches, or 20 inches by 36 inches. The cooktop 16 can be configured to fit within the countertop opening 12 or it may be slightly larger such that a peripheral portion of the cooktop 16 extends beyond the countertop opening 12 to allow a peripheral portion of the cooktop 16 to rest on the countertop 14.

The cooktop 16 can be formed from various materials such as metal, glass, or porcelain. For some types of cooking appliance 10, a heat transmitting material such as a glass-ceramic material (e.g., a vitroceramic glass) is preferable. Glass-ceramic materials such as vitroceramic glass are useful as cooktop materials because they have a very low coefficient of thermal expansion and readily transmit visible and infrared radiation emitted by heating elements. The cooktop 16 can have a thickness from about 2 millimeters to about 15 millimeters, which a thickness of about 4 millimeters being well suited for vitroceramic glass cooktops. The cooktop 16 can include a heating region 18 where cooking is typically carried out and a user interface 20 that includes one or more controls 22 that can be used to control operation of the cooking appliance 10.

Figure 2:
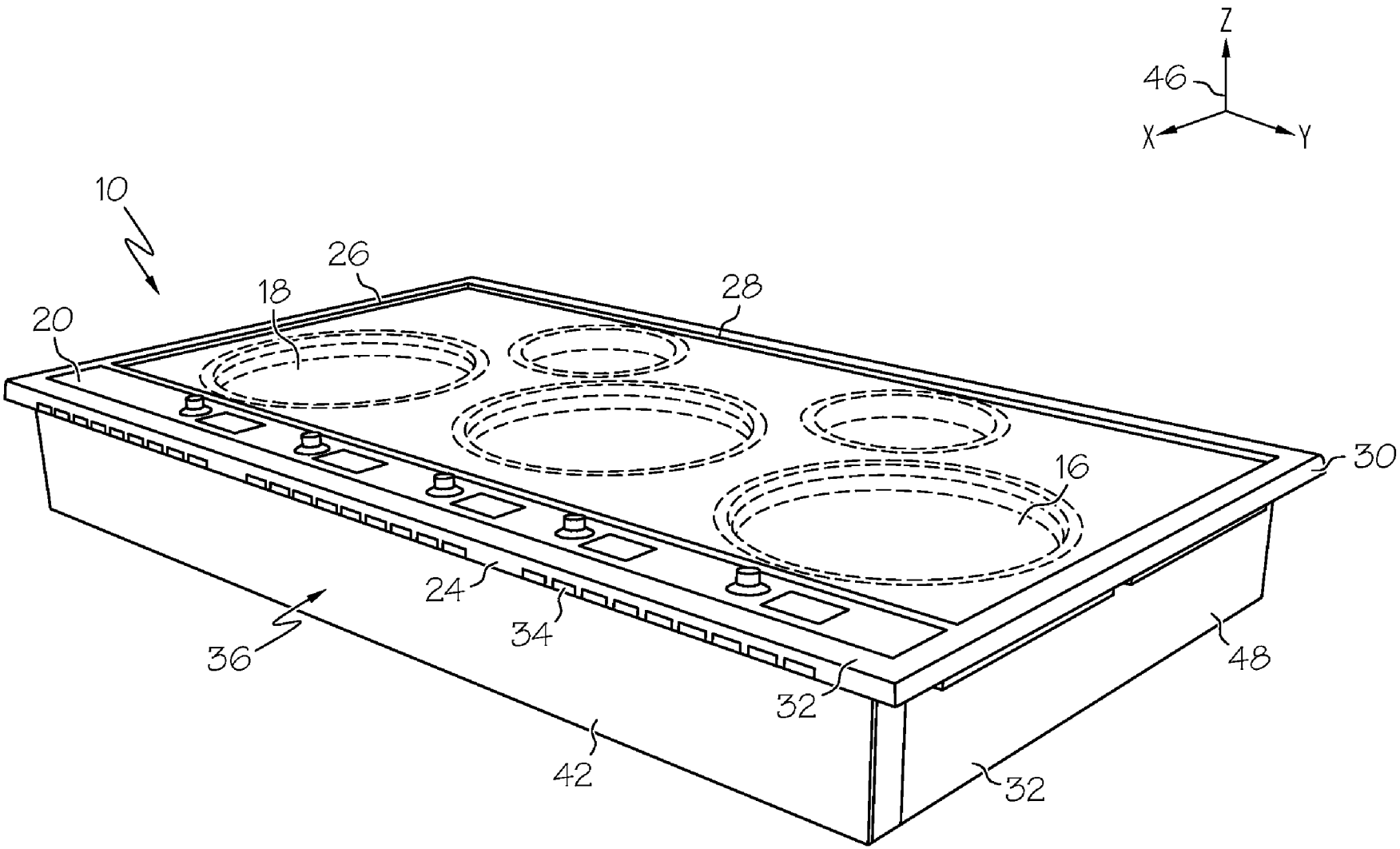
FIG. 2 is an upper right perspective view of an embodiment of a cooking appliance including an air ventilation system.

The cooktop 16 can include one or more cooktop sides along the periphery of the cooktop 16. For example, a rectangular cooktop such as that shown in the figures includes a first cooktop side 24, a second cooktop side 26, a third cooktop side 28 and a fourth cooktop side 30. One or more of the cooktop sides can be covered by a trim 32, which also extends over a portion of the top surface of the cooktop 16. The trim 32 can improve the aesthetics of the cooktop 16 where it rests on the countertop 14, and can be made from a variety of materials such as stainless steel or cold rolled steel with baked enamel. The trim 32 can also include one or more air vents 34 to provide the ventilation system of the cooking appliance 10 with access to outside air. The air vents 34 can be positioned on the sides of the trim 32 to help discourage spillage from entering into the chassis of the cooking appliance 10. The air vents 34 can provide access to the outside air both for the purpose of obtaining cool air to vent into the cooking appliance 10, as well as providing for egress of hot air out from within the cooking appliance 10. The air vents 34 can be a variety of different shapes. For example, the air vents 34 can be a number of slots, as shown in FIGS. 1 and 2. Alternately, the air vents 34 can be long horizontal openings along the lower side of the trim 32.

As shown in FIG. 2, the cooktop 16 is attached on top of a frame 36. The frame 36 includes a bottom wall 38 and a peripheral side portion extending from an outer periphery of the bottom wall 38 to define a chassis for the cooking appliance 10. In the embodiment shown in FIG. 2, the peripheral side portion includes a first frame side 42, a second frame side 44, a third frame side 46, and a fourth frame side 48. The ventilation system of the present invention allows a lower volume chassis to be used, with frame sides that extend downwards from the cooktop 16 by only about 3-4 inches, which can enable the cooking appliance 10 to fit in countertop openings 12 with a smaller depth. This can make it easier to install the cooking appliance 10 over another cooking appliance such as a wall oven.

The cooktop 16 is typically securely attached to the frame 36 so that the cooktop 16 can support the frame 36 when the cooking appliance 10 is placed within the countertop opening 12. However, in some embodiments, small shims (not shown) may be placed underneath the cooktop 16 near the cooktop sides where they will rest on the countertop to provide a gap between the countertop 14 and the cooktop 16 to provide a passage for airflow. When shims are provided, they will typically elevate the cooktop 16 over the countertop 14 by about 1-2 millimeters.

Figure 3:
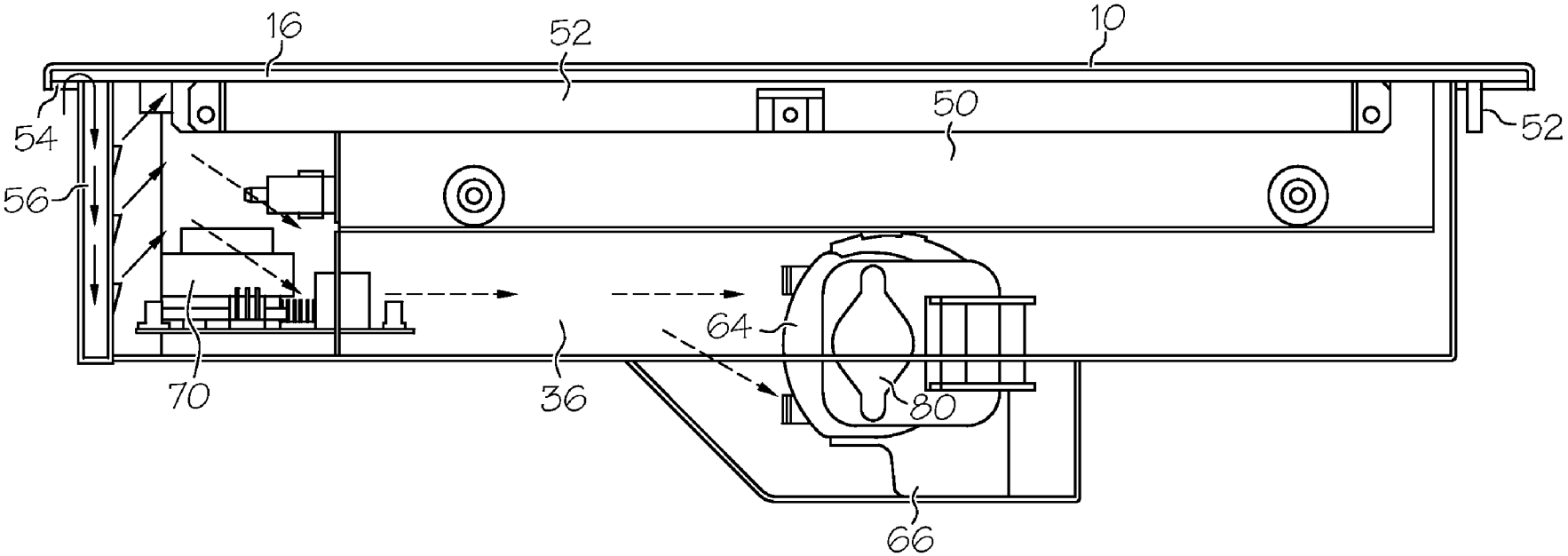
FIG. 3 is a cross-sectional view of a cooking appliance taken along line A-A' in FIG. 1.

A cross-sectional view of an embodiment of the cooking appliance 10 taken along line 3-3' in FIG. 1 is shown in FIG. 3. The cooking appliance 10 includes a heating element enclosure 50 positioned underneath the cooktop 16 and within the frame 36. More specifically, the heating element enclosure 50 is positioned underneath the heating region 18 of the cooktop 16. The cooking appliance 10 can also include one or more cooktop carrier strips 52, which are long rectangular strips of material positioned underneath the cooktop sides to help retain the cooking appliance 10 securely within the countertop opening 12.

The cooking appliance 10 also includes an air inlet 54, which is an opening that allows outside air to enter the cooking appliance 10. The air inlet 54 is a portion (e.g., a cutout) of a cooktop side that has been removed to allow airflow past the cooktop 16 into the cooking appliance 10. The shape of the air inlet 54 can vary. In the embodiments shown in the figures, the air inlet 54 is essentially a long rectangle running along a region of the cooktop side, generally with rounded corners along the inner side of the rectangle. For example, the air inlets 54 can be rectangular cutouts with a length of about 4-8 inches along the side of the cooktop 16 and a depth of about 0.5 to 1 inch into the cooktop 16, or cutouts with a length of about 6-7 inches and a depth of about $\frac{3}{4}^{th}$ of an inch.

Figure 4:
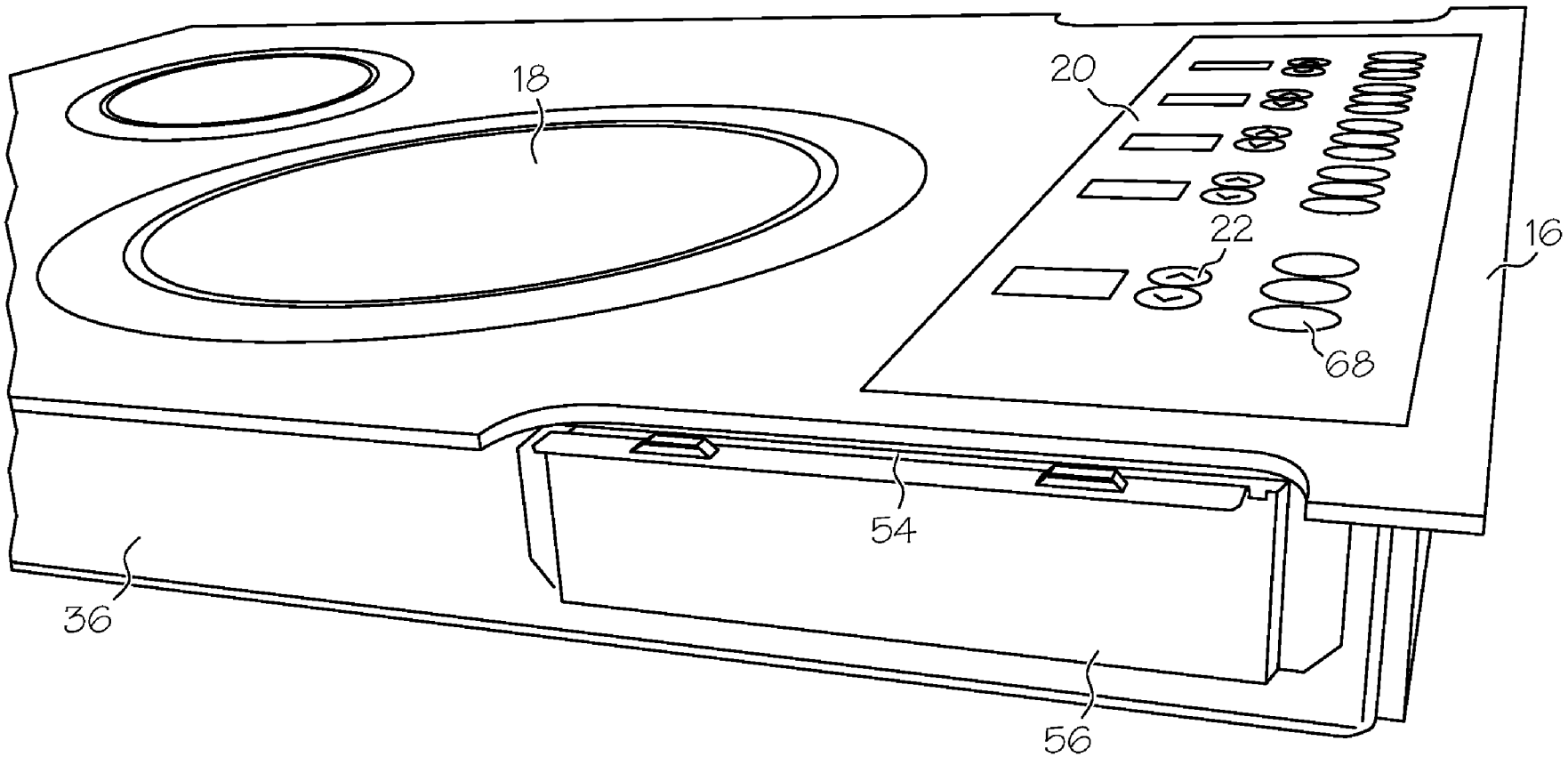
FIG. 4 is a top right perspective view of an air inlet and a deflector mounted to the frame of the cooking appliance.
Figure 5:
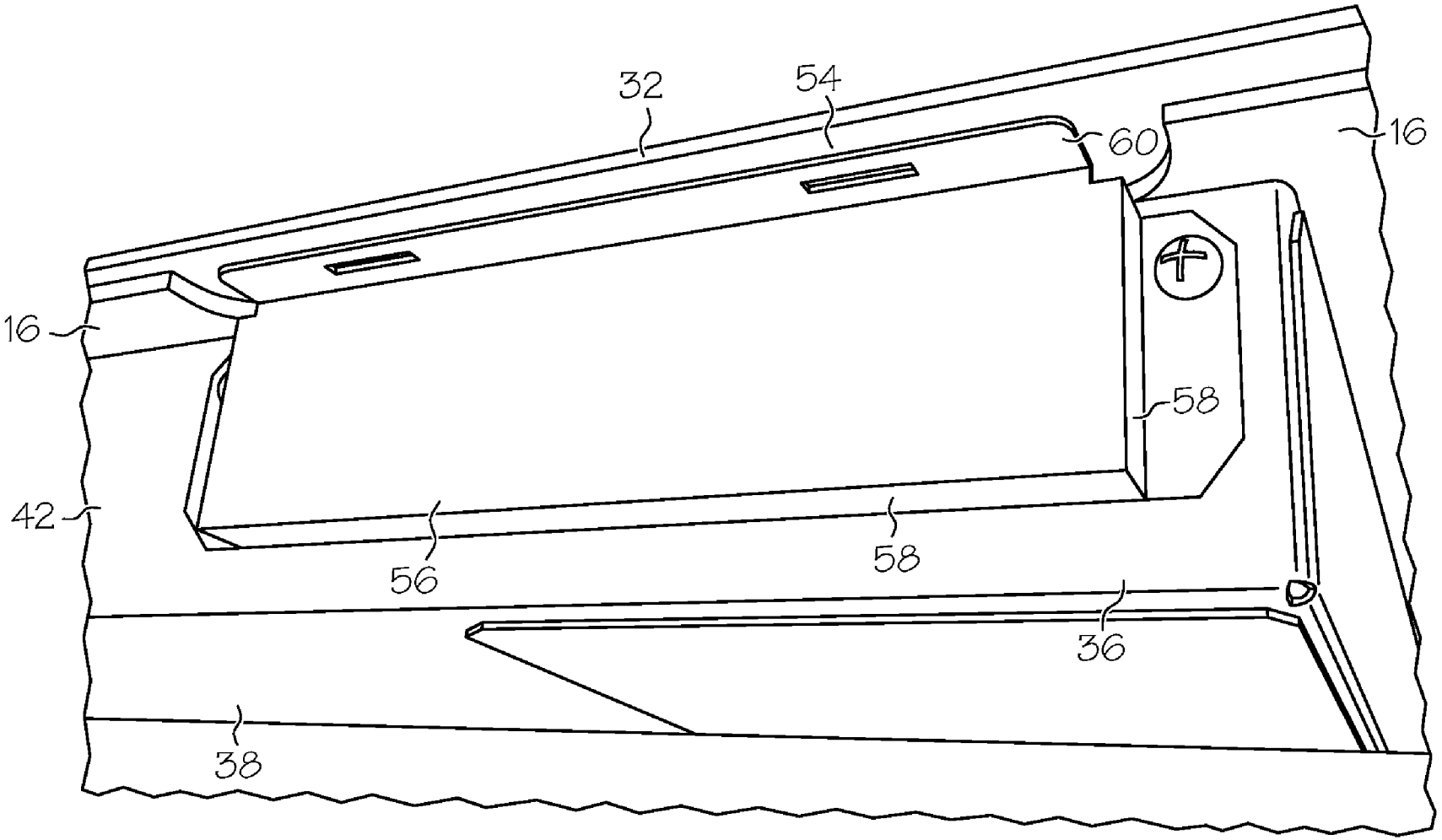
FIG. 5 is a lower right perspective view of an air inlet and a deflector mounted to the frame of the cooking appliance.
Figure 6:
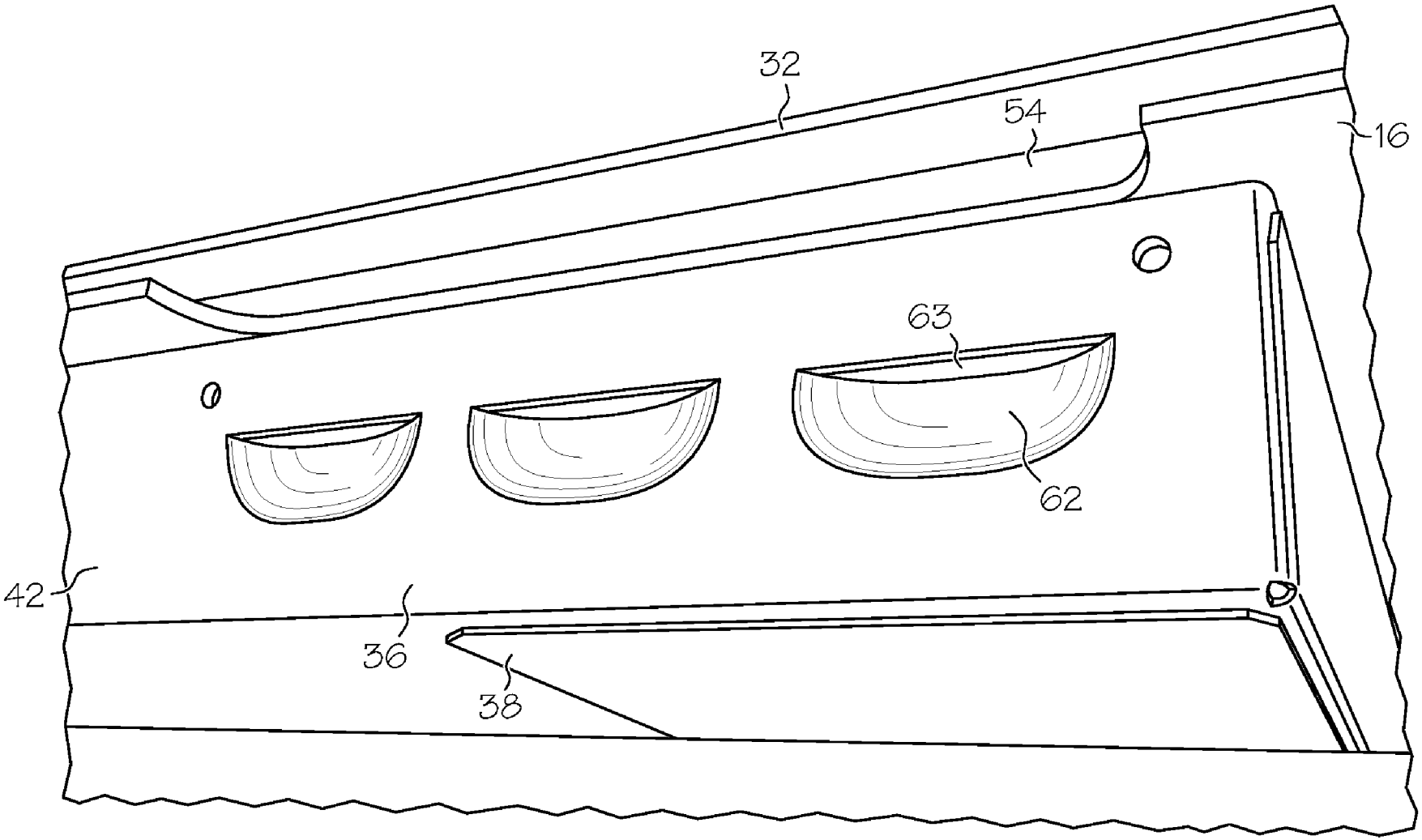
FIG. 6 is lower right perspective view of a side portion of the frame of the cooking appliance in which the deflector has been removed to reveal the side inlets.

The air inlet 54 can be positioned under the trim 32 so that it can readily access one or more air vents 34 in the trim 32. While air inlets 54 positioned on the cooktop side are generally relatively unobtrusive, this is particularly so when they are covered by a trim 32. The air inlet 54 and other components that can be involved in providing ventilation for the cooking appliance 10 are shown in FIGS. 4-6. Air may flow directly from the air inlet 54 into the cooking appliance 10, or it may first enter a deflector 56. Typically if air inlets 54 are provided, there is no need to provide airflow access by elevating the cooktop 16 using shims. However, airflow access can be provided by both means, if desired.

In some embodiments, the cooking appliance 10 includes one or more deflectors 56. FIG. 4 shows an elevated perspective view of an air inlet 54 and a deflector 56, while FIG. 5 shows a lower perspective view of an air inlet 54 and a deflector 56. The deflector 56 is a construct consisting primarily of a sheet of material positioned beneath the air inlet 54 that helps prevent spillage (e.g., water) from leaking from the cooktop 16 into the cooking appliance 10. Accordingly, one or more deflectors 56 can be positioned on the frame 36 adjacent to one or more air inlets 54. The deflector 56 should be positioned on the frame 36 so that its upper edge enters the space provided by the air inlet 54 and above the lower surface of the cooktop 16. However, the upper edge of the deflector 56 should also leave a gap between the top of the cooktop 16 and the upper edge of the deflector 56 to allow airflow. This gap may have a size of about $\frac{1}{16}^{th}$ to about $\frac{1}{8}^{th}$ of an inch, with a gap having a size of about $\frac{3}{32}$nd of an inch being preferred.

The deflector 56 may include deflector sides 58 that are attached to both the deflector 56 and the frame 36 such that the deflector 56 forms a small compartment, open at the top. The deflector 56 can also include a deflector lip 60 positioned at the upper edge of the deflector 56. The deflector lip 60 is a short strip of material that extends outward over a portion of the countertop 14 from the upper edge of the deflector 56, and can help support the cooking appliance 10 in the countertop opening 12.

In addition to reducing the flow of unwanted material into the cooking appliance 10, the deflector 56 can also help direct airflow into the cooking appliance 10. Air flows into the air inlet 54, then into the space behind the deflector 56 and a first frame side 42 of the frame 36, and then into the cooking appliance 10 itself through louvers 62 positioned on the first frame side 42 of the frame 36 and behind the deflector 56. FIG. 6 provides a view of a first frame side 42 of the frame 36 of the cooking appliance 10 in which the deflector 56 has been removed to allow the louvers 62 to be seen. The louvers 62 create louver openings 63 that are perpendicular to the plane of the sheet metal plane. The louvers 62 can vary in size, from a width of about ½ to 3.5 inches, and a gap from the first frame side 42 of about ⅛ to about ¼ of an inch. The louvers are oriented to direct air upwards in order to 62 provide an additional barrier to prevent liquids from being aspired into the chassis of the cooking appliance 10 in the event of a spill on the cooktop 16.

The cooking appliance 10 also includes one or more air movers 64. The one or more air movers 64 impart motion into the air in order to provide the cooking appliance 10 with forced convection cooling. Examples of air movers 64 include fans and cross-flow blowers. Alternately, tube-axial or centrifugal air movers 64 can be used. The one or more air movers 64 are mounted within the frame 36, generally underneath the heating element enclosure 50. Activation of an air mover 64 propels air out of the cooking appliance 10 through one or more air outlets 66, which are openings in the frame 36 of the cooking appliance. The air movers 64 can be mounted to the frame 36 or to a ventilation chamber 72 attached to the frame 36 so that air outlet 66 is directly adjacent to the air mover 64. Positioning the air mover 64 in this fashion causes air movement within the cooking appliance 10 as a result of the formation of negative air pressure within the chassis. It also causes hot air generated by operation of the cooking appliance 10 to be expelled directly out of the cooking appliance 10. Alternately, or in addition, one or more air outlets 66 can be provided at regions more distant from the air mover 64, such as on the sides of the cooktop 16.

The cooktop 16 also includes a user interface 20 with one or more controls 22. The controls 22 are input devices that allow the user to control the operation of the cooking appliance 10. For example, the controls 22 can be touchpad controls that allow the user to activate heating elements 74 within the heating element enclosure 50 to various different temperatures. The user interface 20 can also include display devices 68, such as liquid crystal displays or lights to provide information regarding the operation of the cooking appliance 10.

Within the chassis of the cooking appliance 10 are control circuits 70 that are operatively connected with the controls 22 and display devices 68 of the user interface 20. The control circuits 70 typically include microprocessors and various other items such as analog/digital converters to allow data to be entered into the microprocessor from external sensors, clocks, or various controls 22. The control circuits 70 are typically provided on a printed circuit board that is mounted within the chassis of the cooking appliance 10. The control circuits 70 can be located near the user interface 20 or be positioned in other regions within the chassis. The control circuits 70 are positioned between an air inlet 54 and an air mover 64 such that operation of the air mover 64 draws in air through the air inlet 54 and over the one or more control circuits 70. One or more air inlets 54 can be located close to the control circuits 70 so that relatively cool outside air flows over the control circuits 70. The airflow through the chassis in one embodiment of the invention is shown by arrows in FIG. 3. Ventilation of the control circuits 70 helps decrease the temperature of the control circuits 70 that occurs as a result of heat generated by the heating elements 74.

Figure 7:
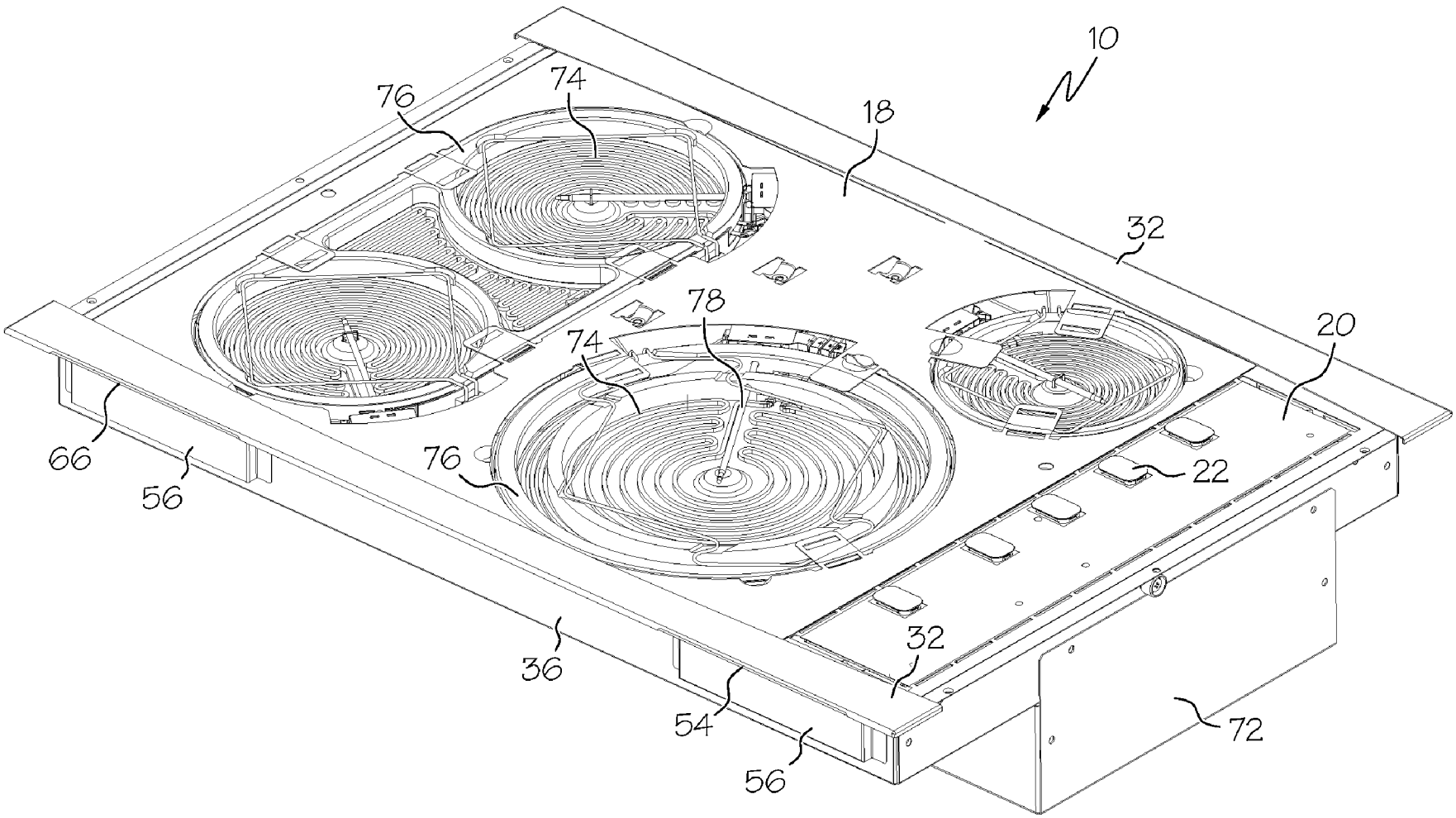
FIG. 7 is a top right perspective view of an embodiment of the cooking appliance in which the cooktop is transparent in order to reveal the heating elements within the heating element enclosure.

FIG. 7 shows a top right perspective view of an embodiment of the cooking appliance 10 in which the cooktop 16 is transparent in order to reveal the heating elements 74 within the heating element enclosure 50. The heating elements 74 are devices that emit heat energy or energy capable of inducing heating in a cooking item that passes through the cooktop 16 to heat cooking items placed on top of the cooktop.

Examples of suitable heating elements 74 include various non-combustion-driven heating elements such as infrared halogen lamps, electric heating coils, ribbon heaters, and induction coils that can induce heating in a ferromagnetic or ferromagnetic cooking item placed over the coil. Ribbon heaters are particularly well-suited for some embodiments. Examples of suitable ribbon heaters include Magma™ ribbon heaters provided by Ceramaspeed Ltd. Alternately, the cooking appliance can include gas burners as heating elements 74, although this requires that gas lines be included and holes provided in the cooktop 16 above the gas burners. Embodiments of the invention can include heating elements can provide high power output (e.g., about 8-11 kilowatts).

The heating element enclosure 50 can include a plurality of heating elements 74 in order to provide a plurality of cooking zones in the cooktop 16. The separate heating elements 74 can be individually controlled using the controls 22 provided in the user interface 20. The heating elements 74 are supported by element mounts 76 provided within the heating element enclosure 50. Thermal limiters 78 can also be associated with the heating elements 74 to monitor the temperature of the heating elements 74 and prevent the cooktop 16 temperatures from rising above a desired level.

Figure 8:
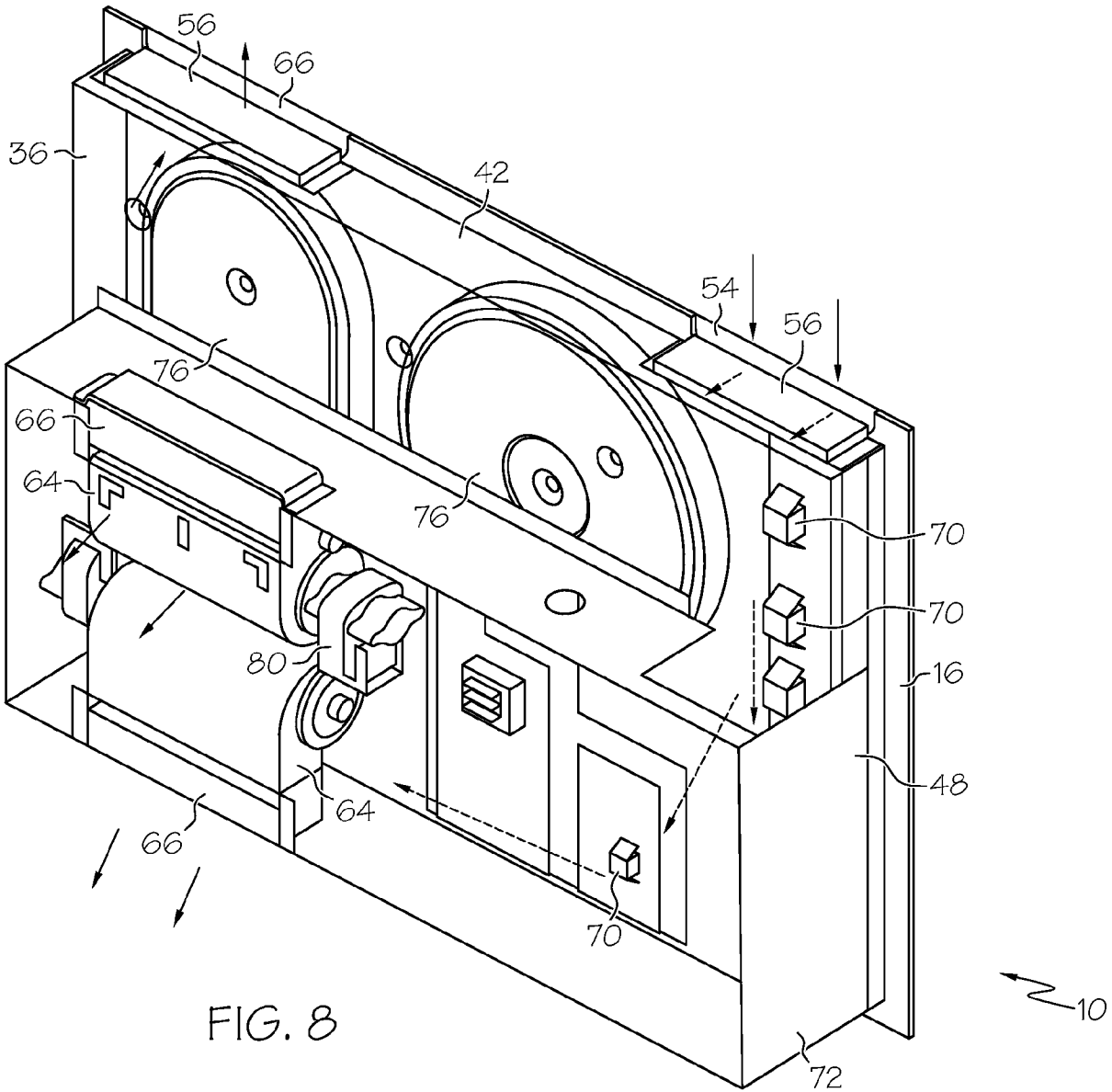
FIG. 8 is a bottom front perspective view of an embodiment of the cooking appliance in which the frame also includes a ventilation chamber.
Figure 9:
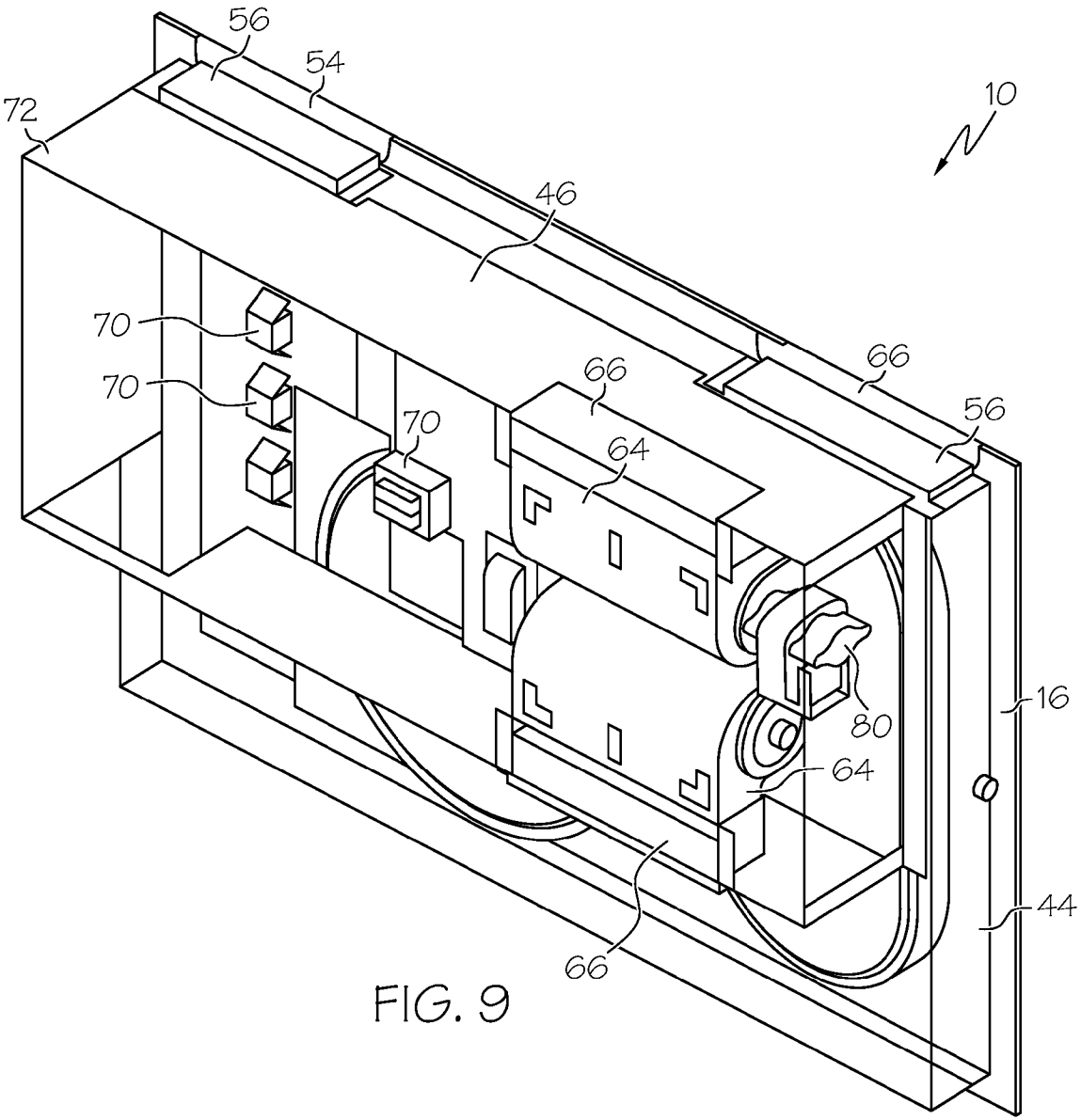
FIG. 9 is a bottom rear perspective view of an embodiment of the cooking appliance in which the frame also includes a ventilation chamber.

FIGS. 8 and 9 provide bottom front and rear perspective views, respectively, of another embodiment of the cooking appliance 10 in which the frame 36 also includes a ventilation chamber 72. The ventilation chamber 72 can be positioned underneath the heating element enclosure 50, and can include one or more air movers 64 positioned to expel air from one or more air outlets 66 provided on the ventilation chamber 72. The air movers 64 can be attached within the ventilation chamber 72 using blower mounts 80. The air outlets 66 and the associated air movers 64 are located at a distance from the air inlets 54 so that air drawn from the outside air through the air inlets 54 and over the control circuits 70 before exiting the cooking appliance 10 at the air outlets 66. This airflow is shown by the arrows in FIGS. 8 and 9. Airflow from air outlets 66 in the ventilation chamber 72 is typically blown into a cabinet beneath the cooking appliance 10. Air outlets 66 can be placed both on the ventilation chamber, and the sides of the cooktop. Air outlets 66 positioned on the sides of the cooktop can be have the same shape as the air inlets 54, and can also be provided with deflectors 56 and covered by trim 32 with air vents 34.

As shown in FIGS. 8 and 9, the cooking appliance 10 can include both a plurality of air inlets 54 and air outlets 66. Air inlets 54 can be positioned on more than one side of the cooktop 16. For example, FIGS. 8 and 9 shown an air inlet 54 positioned on first cooktop side 24 and third cooktop side 28, such that an air inlet 54 is provided at both the front and back of the cooking appliance 10. Similarly, air outlets 66 can be positioned on more than one side of the cooktop 16. For example, FIGS. 8 and 9 also show an air outlet 66 positioned on first cooktop side 24 and third cooktop side 28, such that an air outlet 66 is provided at both the front and back of the cooking appliance 10. Both the air inlets 54 and the air outlets 66 on sides of the cooktop can include deflectors 56. In addition, air outlets 66 can also be provided on the bottom wall 38 of the frame 36, or on the ventilation chamber 72.

While various embodiments in accordance with the present invention have been shown and described, it is understood the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A cooking appliance configured to fit within a countertop opening in a countertop comprising:

a frame including a bottom wall and a peripheral side portion extending from an outer periphery of the bottom wall to define a chassis for the cooking appliance;

a cooktop positioned on top of the frame;

one or more air inlets on a cooktop side of the cooktop;

a heating element enclosure positioned underneath the cooktop and within the frame comprising one or more heating elements;

an air mover underneath the heating element enclosure; and one or more control circuits positioned between the air inlet and the air mover;

wherein operation of the air mover draws in air through the air inlet and over the one or more control circuits, and a deflector positioned on the frame to cover a lower portion of the air inlet, and one or more louvers on the frame arranged behind and covered by the deflector.

2. The cooking appliance of claim 1, wherein the cooktop comprises a glass-ceramic material.

3. The cooking appliance of claim 1, wherein the cooktop includes a plurality of cooking zones.

4. The cooking appliance of claim 1, wherein the heating element is selected from the group consisting of infrared halogen lamps, electric heating coils, ribbon heaters, and induction coils.

5. The cooking appliance of claim 4, wherein the heating element is a ribbon heater.

6. The cooking appliance of claim 1, wherein the heating elements can provide high power output.

7. The cooking appliance of claim 1, wherein the cooktop is about flush with the countertop when the cooking appliance is positioned within the countertop opening.

8. The cooking appliance of claim 1, wherein a trim comprising one or more air vents is positioned over a side of the countertop that includes an air inlet.

9. The cooking appliance of claim 1, further comprising one or more air outlets in one or more cooktop sides of the cooktop.

10. The cooking appliance of claim 1, wherein the cooking appliance comprises a plurality of air outlets.

11. The cooking appliance of claim 1, wherein the cooking appliance comprises a plurality of air inlets.

12. The cooking appliance of claim 1, wherein the frame further comprises a ventilation chamber comprising one or more air movers positioned to expel air through one or more air outlets in the ventilation chamber.

13. The cooking appliance of claim 1, wherein the cooktop comprises a user interface that includes one or more touchpad controls that are operatively connected to the control circuits.

14. The cooking appliance of claim 1, wherein the one or more louvers are oriented to direct air upwards into the chassis.

15. A cooking appliance configured to fit within a countertop opening in a countertop comprising:

a frame including a bottom wall and a peripheral side portion extending from an outer periphery of the bottom to define a chassis for the cooking appliance;

a glass-ceramic cooktop positioned on top of the frame comprising a user interface and a cooking region, wherein the cooktop is about flush with the countertop when placed in an opening in the countertop;

an air inlet on a cooktop side of the cooktop comprising a cutout portion of the cooktop side;

an air outlet in the bottom wall of the frame;

a deflector is positioned on the frame to cover a lower portion of the air inlet;

a heating element enclosure positioned underneath the cooktop and within the frame comprising one or more heating elements;

an air mover underneath the heating element enclosure; and one or more control circuits positioned between the air inlet and the air mover;

wherein operation of the air mover causes air to flow into the air inlet via the cutout portion and over one or more control circuits and then out of the air outlet.

16. The cooking appliance of claim 15, further comprising a plurality of air inlets in one or more cooktop sides of the cooktop.

17. The cooking appliance of claim 15, wherein a trim comprising one or more air vents is positioned over a side of the countertop that includes an air inlet.

18. The cooking appliance of claim 15, wherein the heating element is selected from the group consisting of infrared halogen lamps, electric heating coils, ribbon heaters, and induction coils.

19. The cooking appliance of claim 15, further comprising one or more air outlets in one or more cooktop sides of the cooktop.

20. The cooking appliance of claim 15, further comprising one or more louvers on the frame arranged behind and covered by the deflector.

* * * * *